US007731335B2

(12) United States Patent
Trafton et al.

(10) Patent No.: US 7,731,335 B2
(45) Date of Patent: Jun. 8, 2010

(54) DATA STORAGE DEVICE MOUNTING ARRANGEMENT FOR PRINTING DEVICE

(75) Inventors: R. Winfield Trafton, Brockport, NY (US); Diana C. Petranek, Hilton, NY (US); Mark D. Perkins, Wayland, NY (US)

(73) Assignee: Eastman Kodak Company, Rochester, NY (US)

( * ) Notice: Subject to any disclaimer, the term of this patent is extended or adjusted under 35 U.S.C. 154(b) by 694 days.

(21) Appl. No.: 11/614,160

(22) Filed: Dec. 21, 2006

(65) Prior Publication Data

US 2008/0151032 A1 Jun. 26, 2008

(51) Int. Cl.
*B41J 2/14* (2006.01)
*B41J 2/175* (2006.01)

(52) U.S. Cl. ..... 347/49; 347/86

(58) Field of Classification Search ..... 347/7, 347/19, 49, 85, 86

See application file for complete search history.

(56) References Cited

U.S. PATENT DOCUMENTS

| | | | | |
|---|---|---|---|---|
| 6,039,430 | A * | 3/2000 | Helterline et al. | 347/19 |
| 6,074,042 | A * | 6/2000 | Gasvoda et al. | 347/50 |
| 6,302,535 | B1 * | 10/2001 | Sturgeon et al. | 347/86 |
| 6,502,917 | B1 * | 1/2003 | Shinada et al. | 347/19 |
| 6,565,198 | B2 | 5/2003 | Saruta et al. | 347/86 |
| 6,631,967 | B1 | 10/2003 | Saruta | 347/19 |
| 6,702,427 | B2 | 3/2004 | Shimizu et al. | 347/50 |
| 6,796,646 | B2 | 9/2004 | Komplin et al. | |
| 6,851,799 | B2 | 2/2005 | Trafton et al. | 347/86 |
| 7,008,053 | B2 | 3/2006 | Hashii et al. | 347/86 |
| 7,431,415 | B2 * | 10/2008 | Hetzer et al. | 347/17 |
| 2004/0027432 | A1 | 2/2004 | Childers et al. | |
| 2005/0110850 | A1 | 5/2005 | Studholme et al. | |

FOREIGN PATENT DOCUMENTS

| | | |
|---|---|---|
| DE | 203 20 978 | 7/2005 |
| EP | 1 389 529 | 2/2004 |
| EP | 1 564 004 | 8/2005 |

OTHER PUBLICATIONS

HP 14 Cartridge installation instruction and photos, 3 pages.
HP officejet d series, work with printheads and ink cartridges, pp. 59-70.

* cited by examiner

*Primary Examiner*—Anh T. N. Vo
(74) *Attorney, Agent, or Firm*—David A. Novais; Peyton C. Watkins

(57) ABSTRACT

The present invention provides a pedestal that protrudes from a fluid reservoir device that retains fluid for a fluid-ejection printing device. A data storage device may be mounted on the pedestal such that when the fluid reservoir device is inserted into a supporting structure, the pedestal and data storage device mounted thereon protrude into or through an opening in a surface of the supporting structure. Consequently, a disconnectable connection to the data storage device may be made at a location other than the inside of the supporting structure. Accordingly, connection to the data storage device is simplified and the risk of damage or a reduction in performance to the data storage device or its electrical contacts from fluid leaks from the fluid reservoir device is reduced.

31 Claims, 6 Drawing Sheets

DATA STORAGE DEVICE MOUNTING ARRANGEMENT FOR PRINTING DEVICE

FIELD OF THE INVENTION

This invention relates to a data-storage-device mounting arrangement for a fluid-ejection printing device. In particular, this invention pertains to a data-storage-device mounting arrangement that facilitates simplified connectivity and reduced risk of damage to the data storage device from fluid leaks.

BACKGROUND OF THE INVENTION

Recently, fluid-ejection printing devices, such as ink jet printers have incorporated data storage devices into their fluid reservoir devices in order to track the amount of fluid remaining in the reservoir as well as other important information. Typically, the amount of ink that has been used by fluid ejection and/or by maintenance operations is tracked by counting drop ejection events or maintenance events and multiplying by the amount used per event. Data related to the amount of fluid that has been consumed (starting from a known amount), or the amount of fluid that remains, is stored in the data storage device. In any case, the stored data is related to the amount of fluid remaining in the reservoir. FIGS. 1 and 2 illustrate a conventional scheme, according to U.S. Pat. No. 6,565,198, for mounting such a data storage device on a fluid reservoir device. As shown in FIG. 1, an ink cartridge 107K has a main body 171 in which a bottom-opened recess 173 is formed in a side frame 172. A data storage element 80 is located in the bottom-opened recess 173. The data storage element 80 has connection terminals 174.

As is commonly the case with ink jet printers, ink cartridges such as ink cartridge 107K must be inserted into a supporting structure such as the carriage attachment unit 18 shown in FIG. 2. The '198 Patent discloses that the carriage attachment unit 18 has an inner wall 184, a rear wall 188, a bottom 187, and a recess 183. When the ink cartridge 107K is inserted into the carriage attachment unit 18, a needle 181 penetrates the bottom of the ink cartridge 107K to allow the flow of ink. Carriage guides 182 assist in the registration of the ink cartridge 107K into the carriage attachment unit 18. Further, the data storage element 80, when the ink cartridge 107K is inserted into the carriage attachment unit 18, contacts a connector 186 such that electrodes 185 connect to the connection terminals 174.

Shortcomings of conventional schemes such as that disclosed by the '198 patent include a complex connection structure that requires that electrical wiring be provided from the connection between the data storage element 80 and the connector 186 within the carriage attachment unit 18 to locations external to the carriage attachment unit 18. In other words, the signals received or provided to the connector 186 often need to be provided to control or processing circuitry located remote from the carriage attachment unit 18. In cases such as these, it can be complex to route electrical wires to the connector 186 located within the carriage attachment unit 18. In addition, ink from the ink cartridge 107K may leak therefrom into the carriage attachment unit 18 and cause damage to or reduce the performance of the connection between the connector 186 and the data storage element 80. Accordingly, a need exists in the art for a simpler way to connect to a data storage element on a fluid reservoir device that is less prone to damage from fluid residue or leaks.

SUMMARY OF THE INVENTION

The above-described problems are addressed and a technical solution is achieved in the art by a data-storage-device mounting arrangement for fluid-ejection printing devices according to the present invention. In an embodiment of the present invention, a fluid reservoir device configured to retain fluid has a pedestal protruding therefrom. The pedestal is configured to receive a data storage device and is configured to protrude into or through an opening in a surface of a supporting structure, the supporting structure configured to support at least the fluid reservoir device. By protruding into or through an opening in a surface of the supporting structure, a disconnectable connection can be provided outside of the supporting structure and not inside of the supporting structure, thereby simplifying connectivity to the data storage device. Further, by protruding through an opening in a surface of the supporting structure, the data storage device located on the pedestal is less susceptible to damage or performance decreases due to fluid residue or leaks. Since fluid reservoirs often are recycled, saving them from damage due to ink residue can provide a cost benefit to manufacturers.

According to an embodiment of the present invention, an alignment feature, such as a datum, that facilitates proper alignment between a fluid reservoir device and its supporting structure is provided near the pedestal. Such an alignment feature, according to this embodiment, is close enough to the pedestal so that the alignment feature can further facilitate proper positioning of the pedestal into or through the opening in the surface of the supporting structure.

According to an embodiment of the present invention, the fluid reservoir device may include multiple fluid sub-reservoirs, each sub-reservoir configured to retain its own supply of fluid. According to another embodiment of the present invention, a control circuit located outside the supporting structure, away from the fluid reservoir device, is provided that is communicatively connected to the data storage device via only a single disconnectable connection. According to still yet another embodiment of the present invention, the pedestal extends beyond the inner surface of the supporting structure. According to another embodiment of the present invention, the pedestal is integrally formed with the fluid reservoir device.

In an embodiment of the present invention, a signal interconnection structure is provided. The signal interconnection structure may be configured to provide signals to a printhead, export signals from the printhead, or provide signals to and export signals from the printhead. The signal interconnection structure may be connected to or integrally formed with the supporting structure. Additionally, the signal interconnection structure may be formed along a same plane or substantially a same plane as signal contacts on the data storage device when the fluid reservoir device is properly installed in the supporting structure. Such an arrangement simplifies how the data storage device and the signal interconnection structure can be connected to other circuitry.

According to an embodiment of the present invention, a fluid-providing port on a fluid reservoir device is located near the pedestal. The fluid-providing port is configured to provide fluid from the fluid reservoir device to the printhead. One advantage of providing the fluid providing port near the pedestal is that this facilitates user-friendly and reliable electrical connection, while also minimizing the fluid path length between the fluid providing port and the printhead die.

According to an embodiment of the present invention, a second pedestal is provided that protrudes from a fluid reservoir device into or through an opening in a surface of the supporting structure, and a second data storage device is provided that is located at or substantially near an outer portion, such as a peak or outermost portion, of the second pedestal. The second pedestal may protrude from a second fluid reservoir device, whereas the first pedestal may protrude from a first fluid reservoir device. In this case, the second data storage device may record information about the second fluid reservoir device, and the first data storage device may record information about the first fluid reservoir device. The second pedestal may protrude from a different opening or the same opening as the first pedestal. If the second pedestal protrudes from a different opening as the first pedestal, such opening for the second pedestal may be located in a different surface or the same surface as the first opening.

In addition to the embodiments described above, further embodiments will become apparent by reference to the drawings and by study of the following detailed description.

BRIEF DESCRIPTION OF THE DRAWINGS

The present invention will be more readily understood from the detailed description of exemplary embodiments presented below considered in conjunction with the attached drawings, of which.

It is to be understood that the attached drawings are for purposes of illustrating the concepts of the invention and may not be to scale.

DETAILED DESCRIPTION

Embodiments of the present invention provide a pedestal that protrudes from a fluid reservoir device that retains fluid for a fluid-ejection printing device. A data storage device may be mounted on the pedestal such that when the fluid reservoir device is inserted into a supporting structure, the pedestal and data storage device mounted thereon protrude into or through an opening in a surface of the supporting structure. Consequently, a disconnectable connection to the data storage device may be made at a location other than the inside of the supporting structure. Accordingly, connection to the data storage device is simplified and the risk of damage or a reduction in performance to the data storage device from fluid leaks or fluid residue from the fluid reservoir device is reduced.

Figure 1:
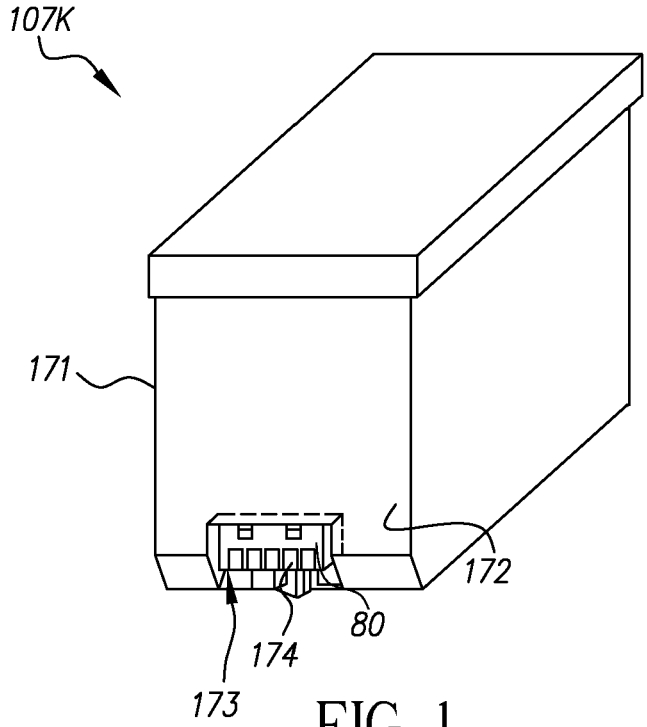
FIG. 1 (Prior Art)
FIGS. 1 and 2 illustrate a conventional technique for connecting a data storage device to a connection structure.
Figure 2:
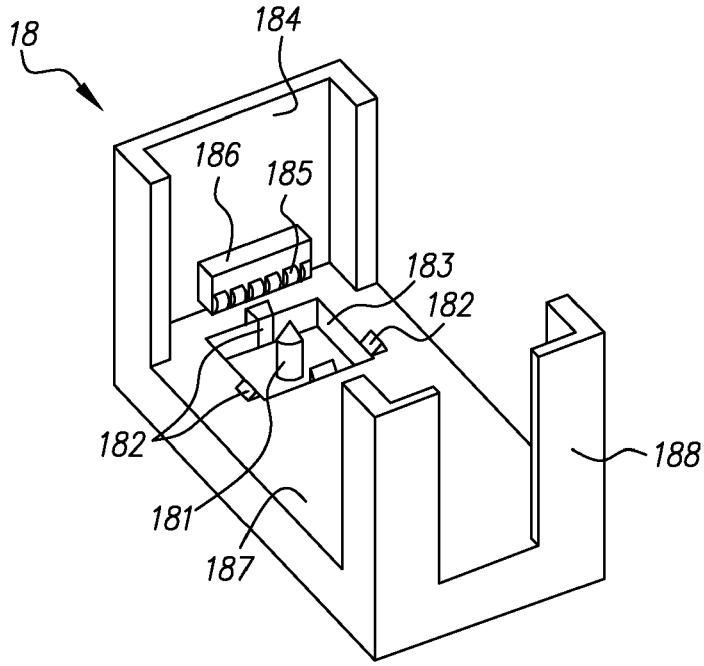
FIG. 2 (Prior Art)
Figure 3:
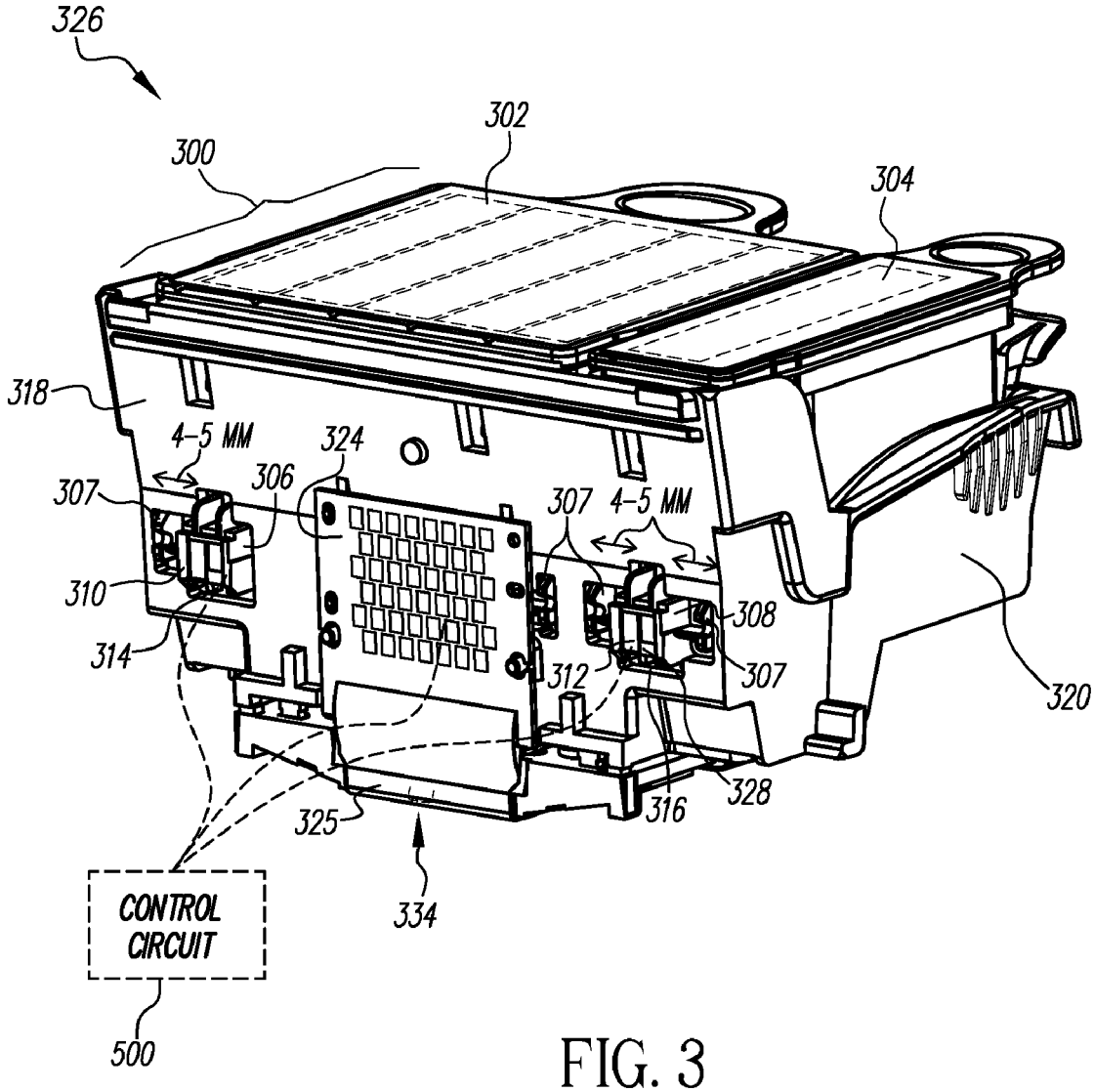
FIG. 3 illustrates a fluid reservoir device and a supporting structure, according to an embodiment of the present invention.

As an example, FIG. 3 illustrates a fluid providing system 300 in a fluid-ejection printing device 326, according to an embodiment of the present invention. Although not required, the fluid-ejection printing device 326 may be all or a portion of an inkjet printer, and the fluid providing system 300 may include a printhead and ink tanks within the inkjet printer.

Figure 4:
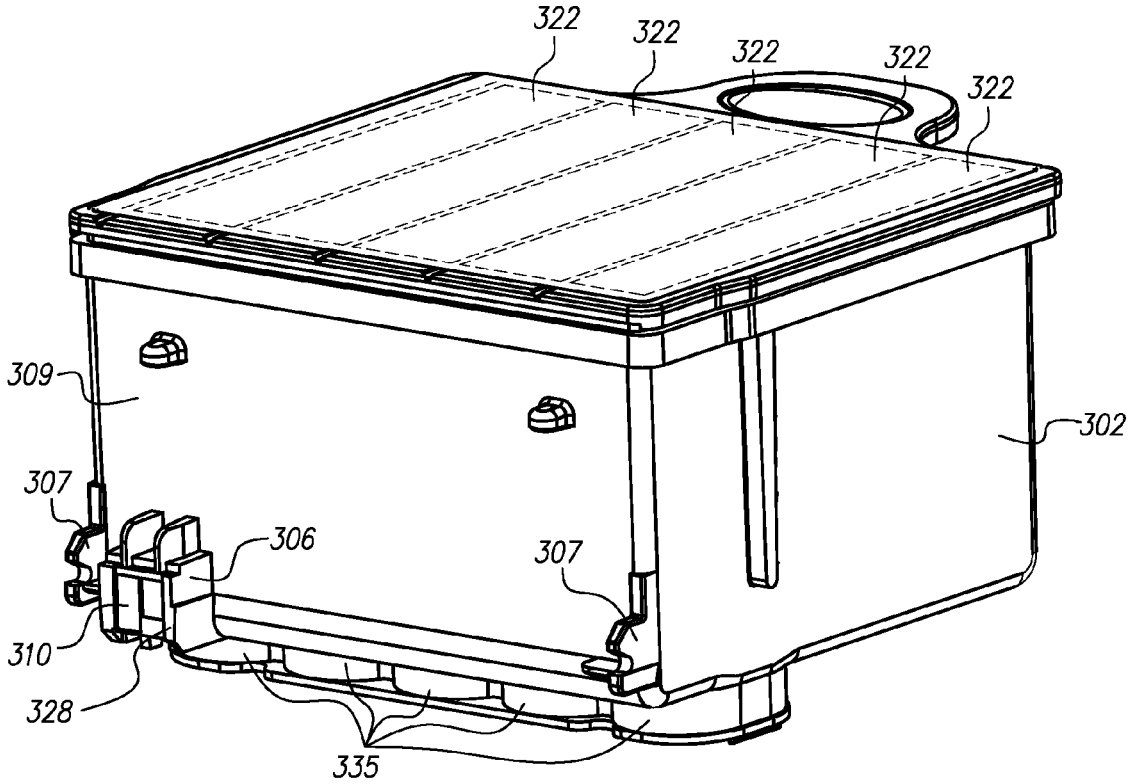
FIG. 4 illustrates a fluid reservoir device according to an embodiment of the present invention.

According to the embodiment of FIG. 3, the fluid providing system 300 includes two fluid reservoir devices 302, 304, and a supporting structure 320. FIG. 4 illustrates a view of the fluid reservoir device 302 separated from the supporting structure 320. The fluid reservoir device 302 includes multiple fluid sub-reservoirs 322 (illustrated in more detail in FIG. 4), each of which may be used for retaining its own fluid supply. Although not required, each fluid sub-reservoir 322 may retain a supply of fluid for a different colored fluid. For example, the fluid sub-reservoirs 322 may respectively retain cyan, magenta, yellow, and black ink used for ink-jet printing. Optionally, one of the fluid sub-reservoirs may retain a clear fluid, for protecting the printed image, for example. The fluid reservoir device 304, on the other hand, includes a single reservoir for retaining a single supply of fluid, such as black ink used for ink-jet printing. Although particular examples of fluid reservoir devices are provided herein, one skilled in the art will appreciate that any fluid reservoir device that retains fluid for a fluid-ejection printing device 326 may be used. It should also be noted that the invention is not limited to any particular arrangements of fluid colors in the fluid reservoir devices 302, 304. In addition, although FIG. 3 includes two fluid reservoir devices 302, 304, one skilled in the art will appreciate that the invention is not so limited and may include only one fluid reservoir device (with one fluid reservoir or multiple fluid sub-reservoirs) or may include more than two fluid reservoir devices (each with one fluid reservoir or multiple fluid sub-reservoirs).

Figure 5:
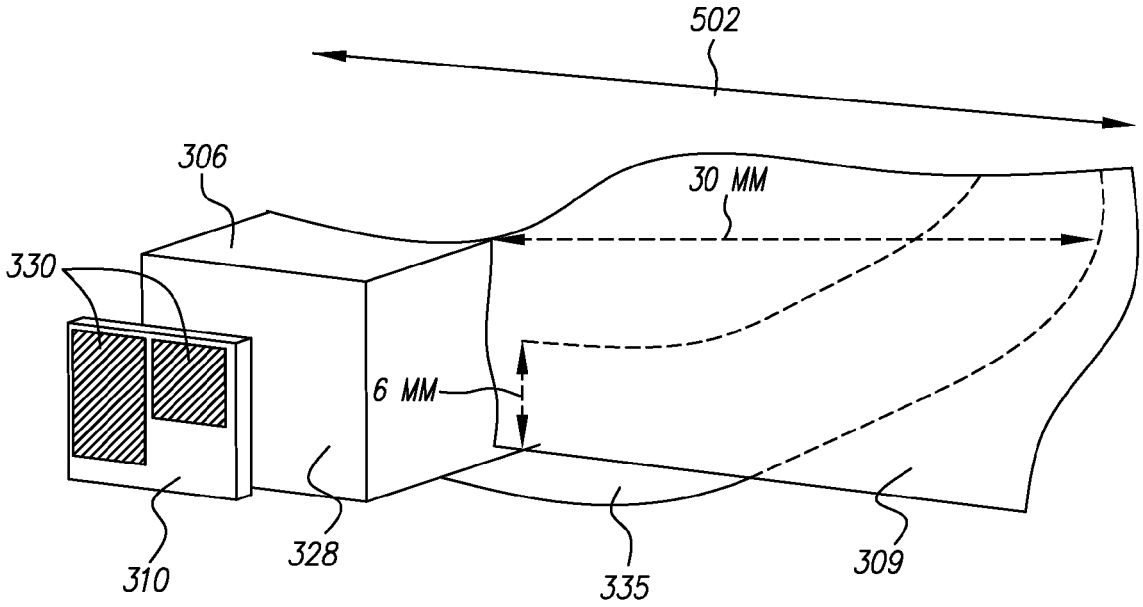
FIG. 5 illustrates a pedestal and a data storage device, according to an embodiment of the present invention.

As shown in FIG. 3, a pedestal 306, which may be integrally formed with the fluid reservoir device 302, extends from the fluid reservoir device 302. Correspondingly, a second pedestal 308, which also may be integrally formed with the second fluid reservoir device 304, extends from the second fluid reservoir device 304. According to this embodiment, a data storage device 310 is located at an outer portion 328 of the pedestal 306. FIG. 4 illustrates the data storage device 310 located at the outer portion 328 of the pedestal 306 when the fluid reservoir device 302 is separated from the supporting structure 320. FIG. 5 illustrates a close-up simplified and exploded view of the pedestal 306 and the data storage device 310.

The view of FIG. 5 illustrates the outer portion 328 of the pedestal 306 upon which the data storage device 310 is mounted. The outer portion 328 may be a peak or an outermost portion of the pedestal 306. It should be noted that this simplified view of the pedestal 306 omits optional gripping features that may extend from the pedestal 306 and wrap around the edges of the data storage device 310 (See FIG. 4). In this regard, the phrase "outer portion" of the pedestal 306 is intended to include within its scope a portion of the pedestal 306 being in front of the data storage device 310. Further in this regard, the phrase "outer portion" is intended to refer to an outer portion of the pedestal 306 that allows the data storage device 310 to be accessed when mounted thereto and the pedestal protrudes into or through an opening in a surface of a supporting structure.

The view of FIG. 5 also illustrates the presence of electrical contacts 330 configured to provide, extract, or both provide and extract information to/from the data storage device 310. These electrical contacts 330 may include, for example, a ground contact and at least one signal contact. Electrical contacts 330 may be on the semiconductor portion of data storage device itself, but more typically, electrical contacts 330 are on a substrate to which the semiconductor portion of the data storage device 310 is electrically connected by a permanent connection. The semiconductor portion (not shown in FIG. 5) may be mounted and encapsulated within the data storage device 310.

Returning to FIG. 3, a second data storage device 312 may be located at an outer portion 328 of the second pedestal 308. Accordingly, each fluid reservoir device 302, 304 may have its own data storage device 310, 312, respectively, to store information, such as an amount of remaining fluid or an amount of fluid used, specific to that fluid reservoir device. The pedestals 306, 308 extend through first and second openings 314, 316, respectively, in a surface 318 of the supporting structure 320. This facilitates a direct and disconnectable connection between electrical contacts 330 on the data storage device 310 and data storage electrical contacts 410 and 412 on printer carriage 400 (see FIG. 7). It should be noted that although the data storage devices 310, 312 are illustrated as being located at outer portions 328 of the pedestals 306, 308, respectively, one skilled in the art will appreciate that the invention is not so limited. In addition, although shown in FIG. 3, the invention is not limited to pedestals 306, 308 that protrude beyond the surface 318 of the supporting structure 320. To the contrary, one skilled in the art will appreciate that any technique that provides an electrical-contact point for a data storage device, such as data storage device 310, not on the inside of the supporting structure 320 will achieve at least one advantage of the present invention. For example, the data storage devices 310, 312 need not be located at outer portions 328 of the pedestals 306, 308, respectively, and may be located substantially near the outer portions 328, such as on a side of the pedestals 306, 308, respectively. As a second example, the data storage electrical contacts 410 and 412 on printer carriage 400 may instead be located on pedestals which protrude out to openings 314 and 316 in supporting structure 320. In this case, data storage devices 310 and 312 would be mounted at the surface of supporting structure 320 (or alternatively on short pedestals) so that the data storage devices 310 and 312 protrude into but not through the openings 314 and 316.

Further, although FIG. 3 shows the pedestals 306, 308 as being rectangular, one skilled in the art will appreciate that any shape may be used, so long as the electrical contacts 330 for the data storage devices 310, 312 are not on the inside of the supporting structure 320.

In addition, although the data storage devices 310, 312 are shown integrally formed with their signal contacts 330, one skilled in the art will appreciate that the data storage devices 310, 312 may be located on the fluid reservoir devices 302, 304, respectively, inside the supporting structure 320, and the contacts 330 may be separately located on the pedestals 306, 308, respectively.

Also, although FIG. 3 shows the pedestals 306, 308 protruding through openings 314, 316, respectively, through a same surface 318 of the supporting structure 320, one skilled in the art will appreciate that the pedestals 306 and 308 may protrude into or through different surfaces of the supporting structure 320, respectively.

According to an embodiment of the present invention, one or more alignment features, such as datums 307, facilitate proper alignment between one or both of the fluid reservoir devices 302, 304 and their supporting structure 320 is/are provided near one or both of the pedestals 306, 308. Such an alignment feature, according to this embodiment, is close enough to the pedestal so that the alignment feature can further facilitate proper positioning of the pedestal into or through the opening in the surface of the supporting structure. In the embodiment shown in FIG. 3, there are two datums 307 symmetrically positioned, one on either side of pedestal 308. There are also two datums 307 that are asymmetrically positioned, one on either side of pedestal 306. Further, in the embodiment of FIG. 3, some of the datums make contact with the top edge of openings 314 and 316 in surface 318 of supporting structure 320. The datum 307 corresponding to pedestal 306 that is furthest from pedestal 306 makes contact with the top edge of a separate opening in surface 318. Further, in this embodiment, the two datums 307 are positioned at or near opposite edges of front surface 309 of fluid reservoir 302, as seen in FIG. 4. By positioning the datum features substantially as far apart from each other as possible on the front surface 309, a more stable alignment is achieved. In one embodiment of the present invention, a datum 307 is provided approximately 4 to 5 mm from corresponding pedestal 306 or 308 (see FIG. 5). Another datum may be located approximately 50 to 60 mm from pedestal 306. One skilled in the art will appreciate, however, that such an alignment features could be provided closer to or farther from their pedestals. Optionally the datum may be incorporated as part of the pedestal (i.e. 0 mm from the pedestal). In summary, the datum may be located within a range of 0 to 60 mm from the pedestal.

Figure 6:
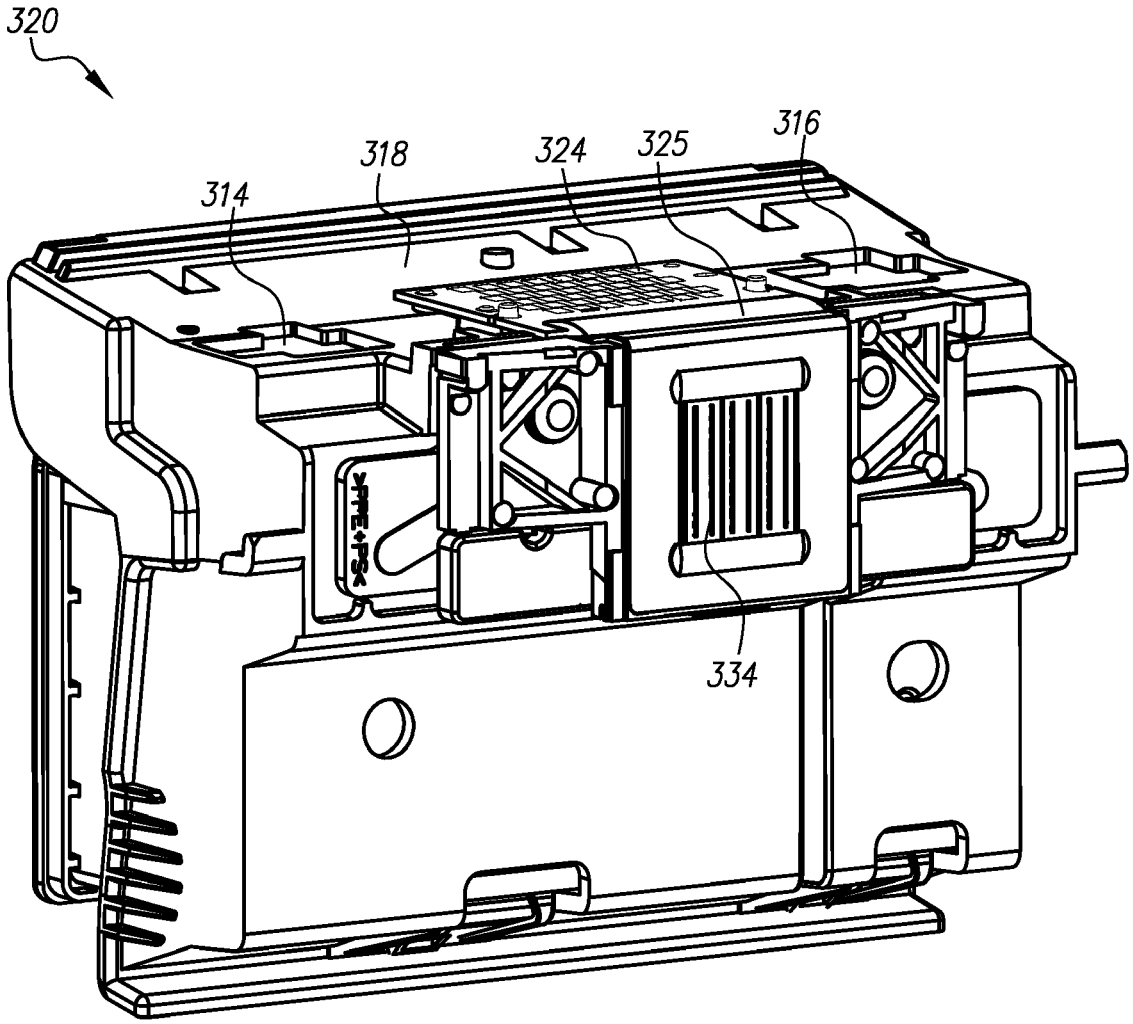
FIG. 6 illustrates an underneath of the supporting structure shown in FIG. 3, according to an embodiment of the present invention.
Figure 7:
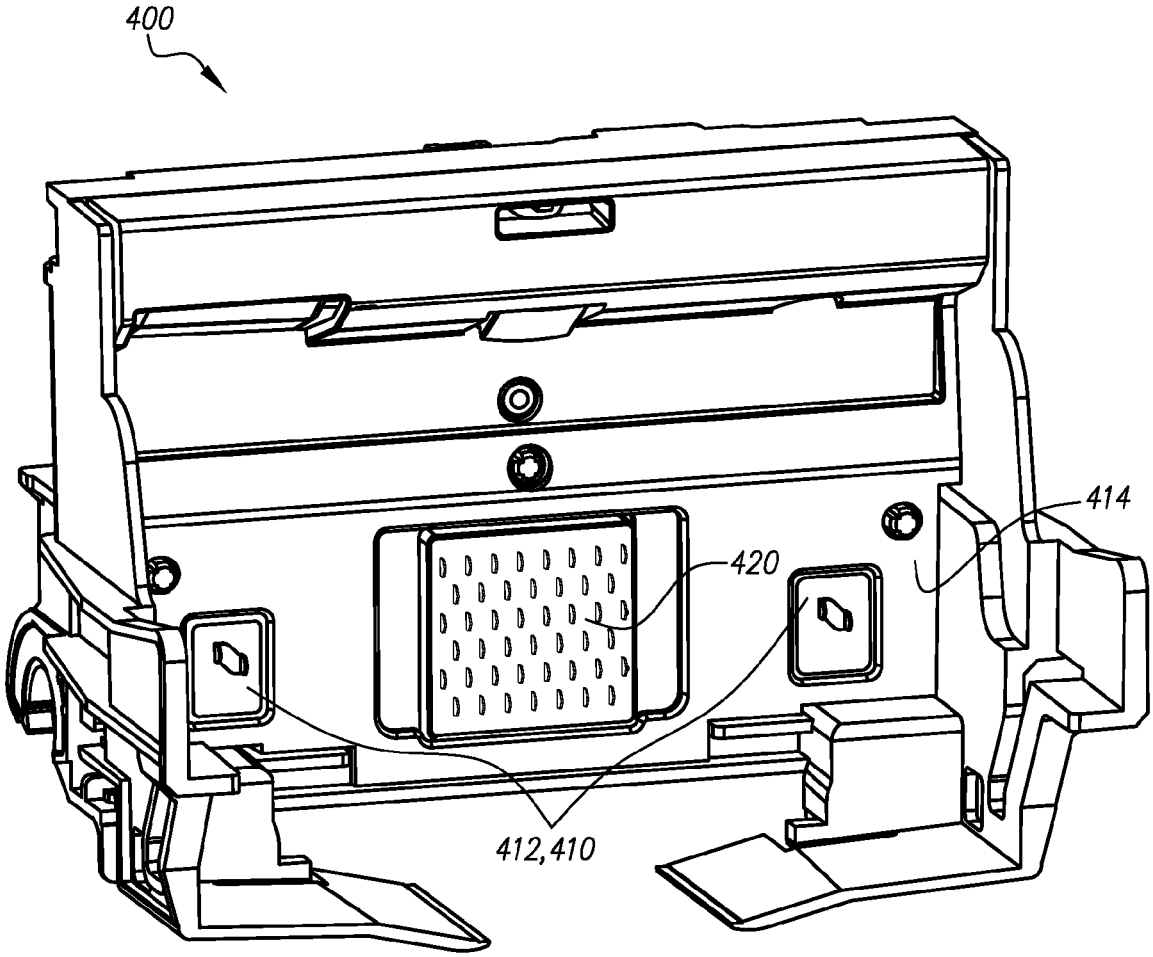
FIG. 7 illustrates a printer carriage that retains the supporting structure of FIGS. 3 and 6, according to an embodiment of the present invention.

The supporting structure 320, according to an embodiment of the present invention, is configured to fit into a printer carriage 400 shown in FIG. 7 of the fluid-ejection printing device. Printer carriage 400 carries the supporting structure 320 and the associated fluid reservoir devices 302, 304 and marking devices along a width of a substrate to form an image while fluid from one of the fluid-reservoir devices 302, 304 is ejected from a marking device. According to an embodiment of the invention shown in FIG. 6, the marking devices include a printhead die 334 located at the bottom of the supporting structure 320, when the supporting structure 320 is in an orientation in which it is configured to operate.

In this regard, FIG. 6 illustrates an underneath of the supporting structure 320 in order to show the printhead die 334. The printhead die 334 need not differ from conventional printheads. Supporting structure 320 together with printhead die 334 may also be called a print cartridge. Although the embodiments of the invention illustrated in the figures show a supporting structure 320 that is carried by printer carriage 400 along a width of a substrate or receiver medium, and a supporting structure 320 having a printhead die 334 located thereon, one skilled in the art will appreciated that the invention is not limited to this particular arrangement of supporting structures. To the contrary, one skilled in the art will appreciate that any structure for supporting fluid reservoir devices will achieve at least one advantage of the present invention. For example, the supporting structure 320 and the carriage 400 need not be separate supporting structures, and, instead, a single supporting structure that performs the functions of both the supporting structure 320 and the carriage 400 may be provided.

Returning to FIG. 7, the printer carriage 400 contains data storage electrical contacts 410 and 412, each configured to make electrical contact with one of the data storage devices 310, 312, respectively, when the fluid-reservoir devices 302, 304 are installed in the supporting structure 320, and the supporting structure 320 is installed in the printer carriage 400. In particular, according to an embodiment of the present invention, the pedestals 306, 308 extend through the first and second openings 314, 316, respectively, in a surface 318 of the supporting structure 320, so that when the supporting structure 320 is installed in the printer carriage 400, data storage electrical contacts 410, 412 mate with corresponding electrical contacts on data storage devices 310, 312, respectively, when the fluid-reservoirs devices 302 and 304 are installed in the supporting structure 320. The connections between the data storage electrical contacts 410, 412 and the data storage devices 310, 312, respectively, facilitate a communicative connection between a control circuit 500 and the data storage devices 310, 312. The control circuit 500, according to an embodiment of the invention, is located outside of the supporting structure 320 (and typically is mounted on the printer frame). The communicative connection between the control circuit 500 and the data storage devices 310, 312, allows the control circuit 500 at least to monitor an operation of the fluid reservoirs 302, 304.

The printer carriage 400 also contains an electrical control circuit connector 420 configured to make electrical contact with the control circuit interconnection structure 324 on the supporting structure 320 when the supporting structure 320 is installed in the printer carriage 400. This electrical contact facilitates a communicative connection between the control circuit 500 and the printhead die 334. The control circuit 500, according to an embodiment of the present invention, provides signals to, exports signals from, or provides and exports signals to/from the printhead die 334 via the signal interconnection structure 324.

To further simplify connecting the data storage devices 310, 312 and the signal interconnection structure 324 to the control circuit 500 via control circuit connector 420 and data storage electrical contacts 410 and 412, the electrical contacts 330 and the signal interconnection structure 324 may be located on or substantially on the same plane. In this case, the control circuit connector 420 and data storage electrical contacts 410, 412 on printer carriage 400, may be arranged along a plane or substantially a same plane, which surface 318 approaches when supporting structure 320 is installed in printer carriage 400 in order to make electrical connection.

According to an embodiment of the present invention, as shown in FIG. 4, one or more fluid-providing ports 335 on a fluid reservoir device (302, for example), is/are located near the pedestal (306, for example) on the fluid reservoir device. The fluid-providing port(s) 335 is/are configured to provide fluid from the fluid reservoir device 302, for example, to the printhead die 334 (FIG. 6).

In this regard, it may be advantageous, although not required, to have the pedestal 306 and the fluid-providing ports 335 located in a front region 502 (FIG. 5) of the fluid reservoir device 302. To elaborate, the front surface 309 of the fluid reservoir device 302 is adjacent the surface 318 of the supporting structure 320 (FIG. 6) when it is installed therein. And, the surface 318 of the supporting structure 320 approaches the surface 414 of the printer carriage 400 (FIG. 7) when it is being installed therein. Consequently, the front region 502 (FIG. 5) of the fluid reservoir device 302 naturally approaches the surface 414 of the printer carriage 400 (FIG. 7) during the insertion process. Therefore, mechanisms that require connection, such as the data storage device 10 on the pedestal 306 and the fluid-providing ports 335 on the fluid reservoir device 302, may advantageously be located in the front region 502 (FIG. 5) to simplify the connection process.

Further in this regard, it also may be advantageous, although not required, to not only have the pedestal 306 and the fluid-providing ports 335 located in the front region 502 (FIG. 5), but also to have them located in proximity to each other. To elaborate, the data storage device 310 makes contact with the electrical contact 410 on the printer carriage 400 (FIG. 7) when installed. Further, the signal interconnection structure 324 (FIG. 6) makes contact with the control circuit connector 420 on the printer carriage 400 (FIG. 7) when installed. Accordingly, to simplify connectivity, it may be advantageous to have the signal interconnection structure 324 proximate the data storage device 310 when the fluid reservoir device 302 is installed in the supporting structure 320.

Further, the signal interconnection structure 324 facilitates the provision of signals to the printhead die 334 (FIG. 6) via flexible printed wiring 325. In order to minimize the size of the flexible printed wiring 325 and, consequently, the cost of the flexible printed wiring 325, it may be advantageous to mount the printhead die 334 near the signal interconnection structure 324, which may be near the data storage device 310, when installed, as discussed above.

In addition, the fluid providing ports 335 (FIG. 4) provide fluid via fluid paths to the printhead die 334 (FIG. 6). In order to minimize the length of the fluid paths between the fluid ports 335 and the printhead die 334, it may advantageous to position the fluid ports 335 near the printhead die 334, when installed in the supporting structure 320. Since, as indicated above, it may also be advantageous for the printhead die 334 to be near the signal interconnection structure 324 and the data storage device 310 when installed, it follows that it may be advantageous for the fluid providing ports 335 to be positioned near the pedestal 306 upon which the data storage device 310 is mounted.

In summary, it may be advantageous, although not required, to have the fluid providing ports 335, the signal interconnection structure 324, and the data storage device 310 on the pedestal 306 near the printhead die 334 to reduce connection lengths. Further, because the front region 502 is a region that naturally approaches the supporting structure 320 during installation, it may be advantageous, although not required, to have the fluid providing ports 335 and the pedestal 306 in the front region 502 of the fluid reservoir device 302 to simplify the connection process. Although this discussion is presented in the context of the multi-chamber fluid reservoir device 302, one skilled in the art will appreciate that its principles apply also to a single chamber fluid reservoir device (304, for example, in FIG. 3). Further, although this discussion is presented in the context of a front region 502 of a fluid-reservoir device, one skilled in the art will appreciate that its principles apply to any region of a fluid reservoir device where the pedestal 306 and the fluid providing ports 335 can be located proximately or any region of a fluid reservoir device that approaches a supporting structure during a process of installing the fluid reservoir device into the supporting structure.

Still further in this regard, according to an embodiment of the present invention, a fluid-providing port 335 is provided anywhere from approximately 6 mm to approximately 30 mm from the pedestal 306 (See FIG. 3). Similarly, a fluid-providing port may be provided anywhere from approximately 6 mm to approximately 30 mm from the pedestal 308. One skilled in the art will appreciate, however, that in some embodiments, a fluid-providing port may be provided closer than 6 mm from a pedestal. In summary, for the fluid-providing port which is closest to the pedestal, it is advantageous for the portion of that fluid-providing port which is proximate the pedestal to be less than 30 mm from the pedestal.

In view of the above descriptions, it can be seen that the electrical contacts 330 of the data storage devices 310, 312 are located outside (or at least not inside) the supporting structure 320. Accordingly, a control circuit can be easily connected thereto without having to route circuitry to the inside of the supporting structure 320. In addition, it is possible to connect control circuitry to the data storage devices 310, 312 via single disconnectable connections at data storage electrical contacts 410 and 412 respectively, both being outside supporting structure 320, as opposed to having one disconnectable connection inside the supporting structure 320 and another outside the supporting structure 320 for each of data storage devices 310 and 312. Further, if fluid leaks from one of the reservoirs 302, 304, it is more difficult for such fluid to damage the data storage devices 310, 312 or their electrical contacts 330, because they are not located inside the supporting structure 320.

It is to be understood that the exemplary embodiments are merely illustrative of the present invention and that many variations of the above-described embodiments can be devised by one skilled in the art without departing from the scope of the invention. It is therefore intended that all such variations be included within the scope of the following claims and their equivalents.

PARTS LIST

300 fluid providing system
302 fluid reservoir device
304 fluid reservoir device
306 pedestal
307 datum
308 second pedestal
309 front surface of fluid reservoir device
310 data storage device
312 second data storage device
314 first opening
316 second opening
318 surface
320 supporting structure
322 multiple fluid sub-reservoirs
324 signal interconnection structure
325 flexible printed wiring
326 fluid-ejection printing device
328 outer portion
330 electrical contacts
334 printhead
335 fluid-providing port
400 printer carriage
410 electrical contact
412 electrical contact
414 surface of printer carriage 400
420 control circuit connector
500 control circuit
502 front region of fluid reservoir device

What is claimed is:

1. A fluid-providing system configured to provide fluid to a fluid-ejecting printing device, the fluid-providing system comprising:

a fluid reservoir device configured to retain fluid adapted at least to facilitate forming an image;

a pedestal protruding from a first surface of the fluid reservoir device, the pedestal configured to receive a data storage device and configured to protrude into or through an opening in a surface of a supporting structure, the supporting structure configured to support at least the fluid reservoir device; and a first alignment feature protruding from the first surface and disposed on a first side of the pedestal; and a second alignment feature protruding from the first surface, the second alignment feature being disposed on a second side of the pedestal, the second side being opposite the first side, wherein the first and second alignment features are configured to facilitate proper positioning of the pedestal into or through the opening in the surface of the supporting structure.

2. The fluid-providing system of claim 1, wherein the fluid reservoir device includes multiple fluid sub-reservoirs, each sub-reservoir configured to retain its own supply of fluid.

3. The fluid-providing system of claim 2, wherein one of the fluid sub-reservoirs is configured to retain fluid of a different color than another of the fluid sub-reservoirs.

4. The fluid-providing system of claim 1, wherein the fluid is ink compatible for use by an ink-jet printer.

5. The fluid-providing system of claim 1, further comprising the data storage device located at or substantially near an outer portion of the pedestal, the data storage device having a plurality of electrical contacts.

6. The fluid-providing system of claim 5, further comprising the supporting structure supporting the fluid reservoir device, the pedestal protruding into or through the opening of the supporting structure such that the electrical contacts of the data storage device are accessible from a side of the supporting structure opposite a side of the supporting structure that faces the fluid reservoir device.

7. The fluid-providing system of claim 6, wherein the data storage device and its electrical contacts are protected or substantially protected from fluid leaks from the fluid reservoir device at least because they are accessible from the side of the supporting structure opposite the side of the supporting structure that faces the fluid reservoir device.

8. The fluid-providing system of claim 1, wherein the data storage device is configured to retain data related to at least a fluid amount remaining in the fluid reservoir device.

9. The fluid-providing system of claim 1, wherein the first and/or second alignment feature contacts an edge of the opening.

10. The fluid-providing system of claim 9, wherein the first and/or second alignment feature is located less than approximately 60 mm from the pedestal.

11. The fluid-providing system of claim 1, further comprising a fluid-providing port, wherein the portion of the fluid providing port which is proximate the pedestal is less than 30 mm from the pedestal.

12. The fluid-providing system as in claim 1, wherein the first alignment feature is closer to the pedestal than the second alignment feature.

13. An ink tank for providing ink to an inkjet printer, the ink tank comprising:

(a) a fluid reservoir that contains the ink;

(b) a pedestal having an electrical contact, and the pedestal extends from a first surface of the housing and is configured to protrude into or through an opening in a surface of a support structure that supports at least the housing;

(c) a first alignment feature protruding from the first surface and disposed on a first side of the pedestal; and (d) a second alignment feature protruding from the first surface, the second alignment feature being disposed on a second side of the pedestal, the second side being opposite the first side, wherein the first and second alignment features are configured to facilitate proper positioning of the pedestal into or through the opening in the surface of the supporting structure.

14. The ink tank as in claim 13, wherein the fluid reservoir includes multiple fluid sub-reservoirs, each sub-reservoir retaining its own supply of fluid.

15. The ink tank as in claim 14, wherein one of the fluid sub-reservoirs is configured to retain fluid of a different color than another of the fluid sub-reservoirs.

16. The ink tank as in claim 14, wherein the electrical contact is located at or substantially near an outer portion of the pedestal and includes a plurality of electrical contacts.

17. The ink tank as in claim 16, wherein the pedestal protrudes into or through the opening of the supporting structure such that the electrical contacts are accessible from a side of the support structure opposite a side of the support structure that faces the housing.

18. The ink tank as in claim 17, wherein the electrical contacts are protected or substantially protected from fluid leaks from the fluid reservoir at least because they are accessible from the side of the supporting structure opposite the side of the supporting structure that faces the housing.

19. The ink tank as in claim 14, wherein the electrical contact is a data storage device configured to retain data related to at least a fluid amount remaining in the fluid reservoir device.

20. The ink tank as in claim 14, wherein the first and/or second alignment feature contacts an edge of the opening.

21. The ink tank as in claim 20, wherein the first and/or second alignment feature is located less than approximately 60 mm from the pedestal.

22. The ink tank as in claim 14, further comprising a fluid-providing port, wherein a portion of the fluid-providing port which is proximate the pedestal is less than 30 mm from the pedestal.

23. The ink tank as in claim 14, wherein the first alignment feature is closer to the pedestal than the second alignment feature.

24. The ink tank as in claim 13, wherein the fluid reservoir is a single fluid reservoir.

25. The ink tank as in claim 24, wherein the electrical contact is located at or substantially near an outer portion of the pedestal and includes a plurality of electrical contacts.

26. The ink tank as in claim 25, wherein the pedestal protrudes into or through the opening of the support structure such that the electrical contacts are accessible from a side of the support structure opposite a side of the support structure that faces the housing.

27. The ink tank as in claim 26, wherein the electrical contacts are protected or substantially protected from fluid leaks from the fluid reservoir at least because they are accessible from the side of the supporting structure opposite the side of the supporting structure that faces the housing.

28. The ink tank as in claim 24 further comprising a data storage device configured to retain data related to at least a fluid amount remaining in the fluid reservoir device and the data storage device is in electrical communication with the electrical contact.

29. The ink tank as in claim 24, wherein the first and/or second alignment feature contacts an edge of the opening.

30. The ink tank as in claim 29, wherein the first and/or second alignment feature is located less than approximately 60 mm from the pedestal.

31. The fluid-providing system as in claim 24, further comprising a fluid-providing port, wherein a portion of the fluid-providing port which is proximate the pedestal is less than 30 mm from the pedestal.

* * * * *